US011230433B2

(12) United States Patent
Ferrara

(10) Patent No.: US 11,230,433 B2
(45) Date of Patent: Jan. 25, 2022

(54) AUTOMATIC ROLL-TOP WASTE CONTAINER WITH A SPRING-ACTIVATED LID

(71) Applicant: Dennis Ferrara, Brooklyn, NY (US)

(72) Inventor: Dennis Ferrara, Brooklyn, NY (US)

( * ) Notice: Subject to any disclaimer, the term of this patent is extended or adjusted under 35 U.S.C. 154(b) by 331 days.

(21) Appl. No.: 16/160,502

(22) Filed: Oct. 15, 2018

(65) Prior Publication Data

US 2020/0024073 A1 Jan. 23, 2020

Related U.S. Application Data

(63) Continuation-in-part of application No. 29/656,990, filed on Jul. 18, 2018, now Pat. No. Des. 872,963.

(51) Int. Cl.
*B65F 1/16* (2006.01)
*B65F 1/14* (2006.01)

(52) U.S. Cl.
CPC ..... *B65F 1/1615* (2013.01); *B65F 1/1473* (2013.01)

(58) Field of Classification Search
CPC .... B65D 88/125; B65F 1/1615; B65F 1/1623; B65F 2001/1653; A45C 13/16
See application file for complete search history.

(56) References Cited

U.S. PATENT DOCUMENTS 4,720,222 A * 1/1988 Nagy ..... B60P 7/15 403/167
4,807,921 A * 2/1989 Champie, III ..... B60J 7/068 160/235
6,276,735 B1 * 8/2001 Champion ..... B60J 7/041 296/100.06

* cited by examiner

*Primary Examiner* — Andrew T Kirsch

(57) ABSTRACT

An automatic, roll-top waste container with a spring-activated lid includes a receptacle, a flexible lid, a sleeve, a retraction mechanism, and a locking mechanism. The receptacle has curved corners that prevent a trash bag from tearing while being loaded and unloaded. The flexible lid is slidably engaged over an opening of the receptacle. In the open position, the retraction mechanism retracts the flexible lid into the sleeve for storage and safe-keeping. To close the receptacle, a user must manually pull the flexible lid out of the sleeve and engage the locking mechanism. The locking mechanism is operatively coupled onto a front wall of the receptacle. In the engaged position, the locking mechanism prevents the flexible lid from retracting into the sleeve. The user can disengage the locking mechanism to allow the flexible lid to retract back into the sleeve.

6 Claims, 10 Drawing Sheets

AUTOMATIC ROLL-TOP WASTE CONTAINER WITH A SPRING-ACTIVATED LID

FIELD OF THE INVENTION

The present invention generally relates to an automatic and roll-top waste container with a spring-activated lid. More specifically, a flexible lid is slidably connected over an opening of a waste container and retracts into a sleeve of the waste container for storage and safe-keeping.

BACKGROUND OF THE INVENTION

Currently, sanitary workers must exercise some degree of caution when transporting a trash can to and from the garbage truck. Most conventional trash cans utilize flip-top lids that are hingedly connected to the trash can. In the open position, the flip-top lid can fling about unpredictably and can pose a safety hazard to the sanitary workers who must empty the trash can. If the workers push too hard or are going over curbs and bumps, the lid can swing open and hit the workers' arms or hands. This can also cause waste to spill onto the sidewalk making more work for the workers. Over the life of the trash can, the lid must withstand considerable abuse as it is opened and closed hundreds of times. In many cases, this causes the hinge to fail and lid breaks off the trash can. As such, the lid often gets lost which brings considerable fines to the owner of the trash can. In other cases, the lid is snapped or screwed onto the trash which causes the lid to be lost or stolen when separated from the trash can.

Further, trash cans with flip-top lids are also susceptible to infiltration from rats, raccoons, or vermin. Flip-tops lids are often poorly secured and allow small animals to easily open the trash can and rummage through the trash. Raccoons in particular are very intelligent and are known to tip over the trash can to access the interior. Once tipped over, the raccoons can easily open the flip-top lid and remove the trash. As such, a more secure and animal-proof lid is required.

The present invention is a roll-top waste container with a spring-activated flexible lid that retracts into a sleeve of the waste container for storage and safe keeping. The flexible lid has a front clasp and is slidably connected onto a receptacle that holds the trash. The front clasp engages with the front latch when the lid is in the closed position. The clasp has a handle which can be pushed down to release the lid from the closed position into an open position. A rear handle is on the rear of the receptacle to allow a user to tilt and roll the receptacle. The slidable connection between the flexible lid and the receptacle ensures that the flexible lid always remains connected to the receptacle. This also prevents the flexible lid from hitting and causing injury to the workers.

DETAILED DESCRIPTION OF THE INVENTION

All illustrations of the drawings are for the purpose of describing selected versions of the present invention and are not intended to limit the scope of the present invention.

Figure 1:
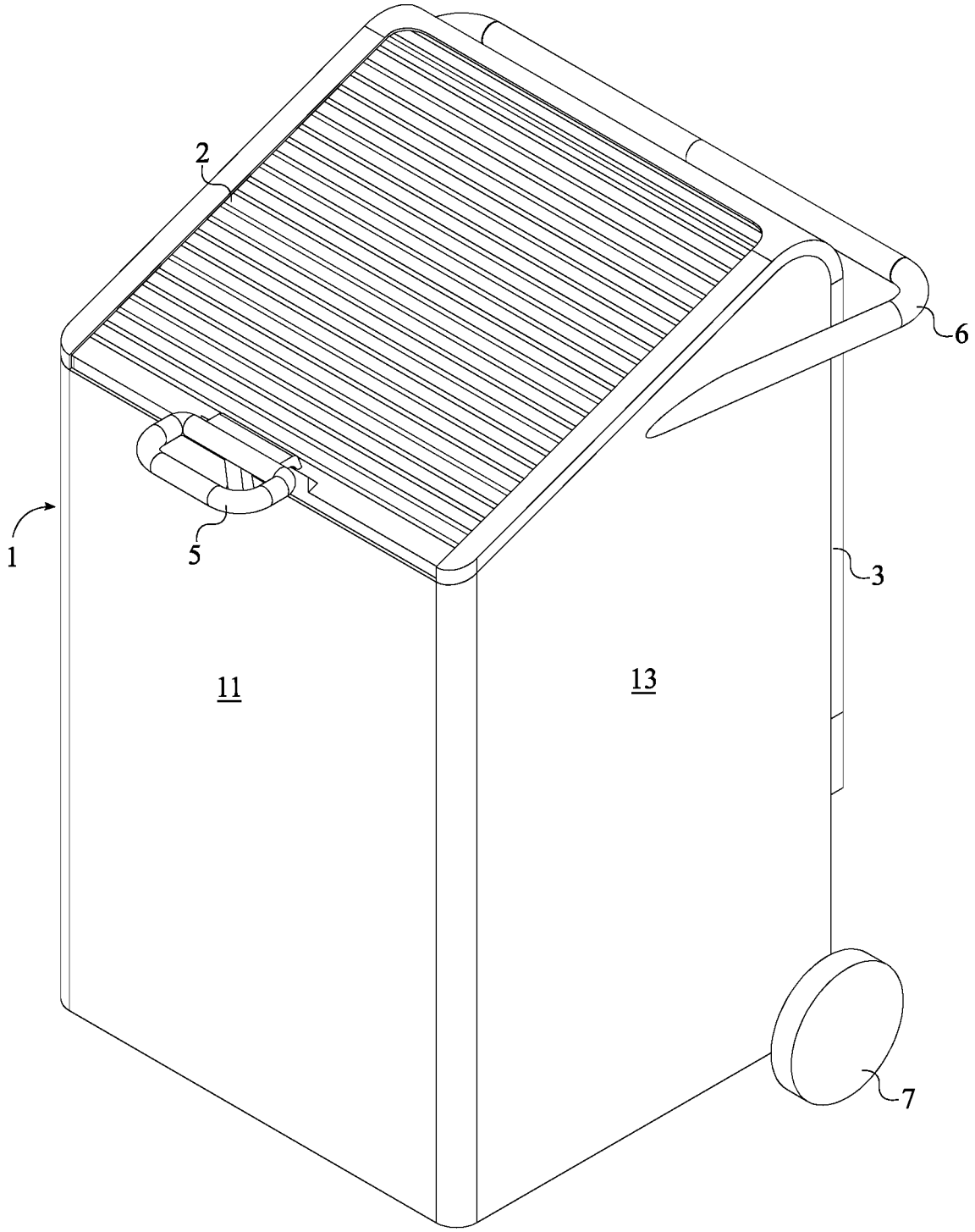
FIG. 1 is a front perspective view of the present invention illustrating the flexible lid in the closed position.
Figure 2:
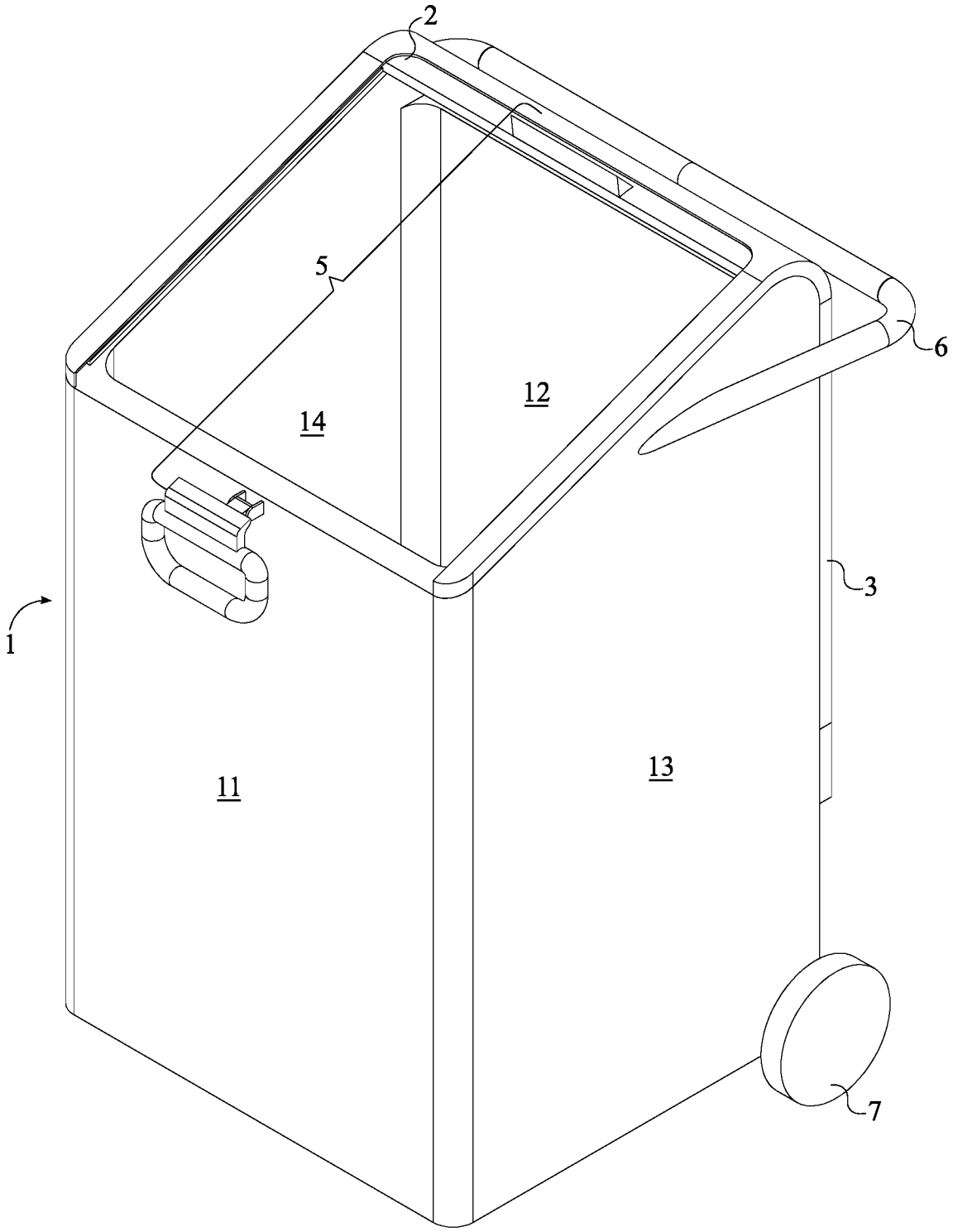
FIG. 2 is a front perspective view illustrating the flexible lid in the open position.
Figure 3:
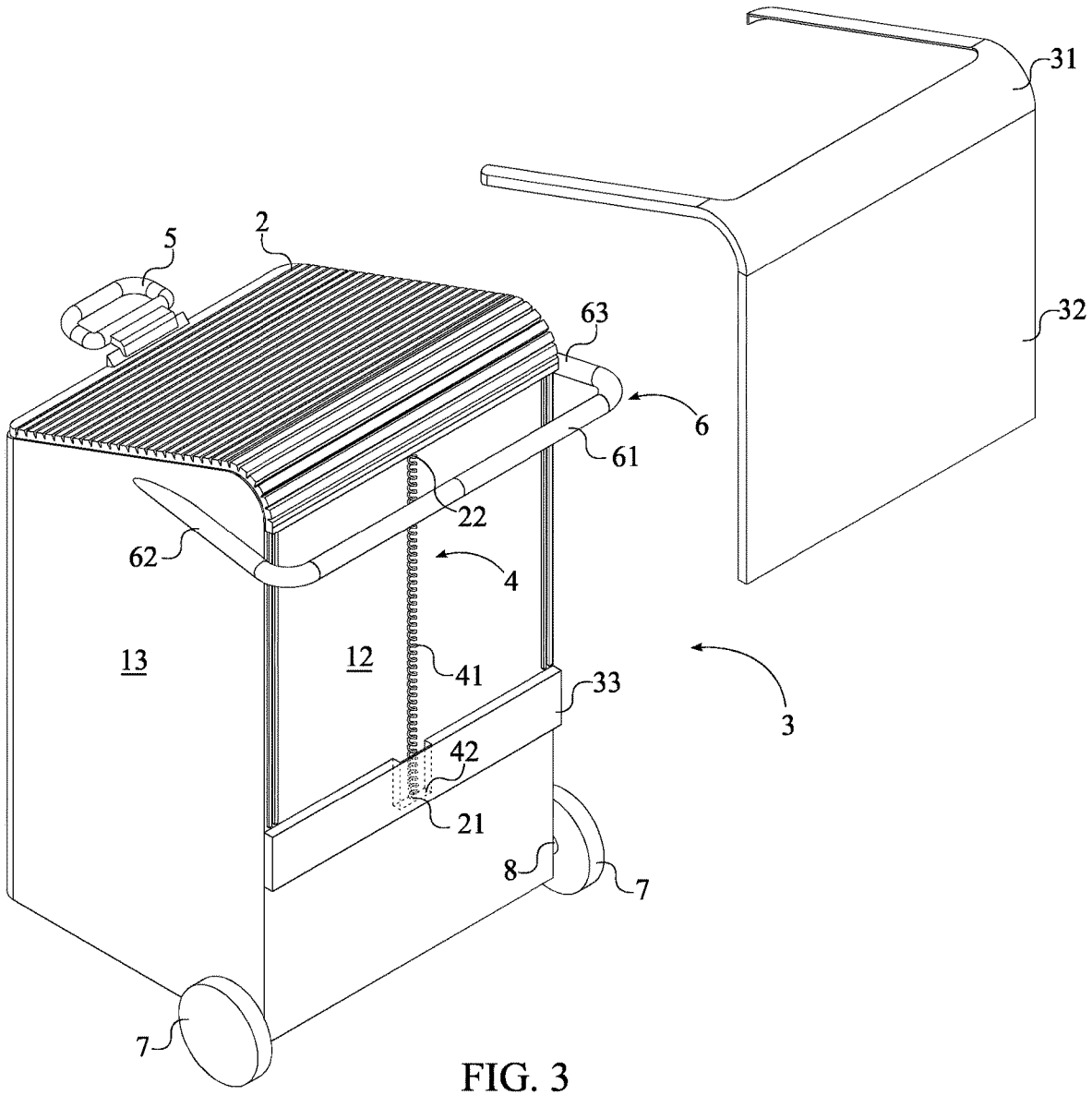
FIG. 3 is a rear perspective view of the present invention with the guide track cover and the lid cover removed, illustrating the retraction mechanism connected to the flexible lid in the closed position.

Referring to FIG. 1, FIG. 2, and FIG. 3, the present invention is a roll top waste container with a spring-activated lid that slides into a sleeve in the back of the roll top waste container for storage and safe-keeping. The preferred embodiment of the present invention comprises a receptacle 1, a flexible lid 2, a sleeve 3, a retraction mechanism 4, and a locking mechanism 5. In the preferred embodiment, the receptacle 1 has a slanted top surface to allow rainwater to flow away from an opening. The opening of the receptacle 1 leads into an interior compartment that holds the trash bag. Preferably, the interior compartment has curved sides to prevent the trash bag from tearing while being loaded and unloaded.

Referring more specifically to FIG. 2 and FIG. 3, in the preferred embodiment, the flexible lid 2 is designed to always remain engaged to the receptacle 1, thus preventing the flexible lid 2 from getting lost or stolen. Further, the flexible lid 2 is also slidably engaged to the receptacle 1 to eliminate the possibility of the user's fingers getting trapped between the flexible lid 2 and the opening, as is common with flip-top lids. The preferred flexible lid 2 is made of a plurality of plastic panels rotatably connected to each other. In the open position, flexible lid 2 is stored in the sleeve 3. To close the receptacle 1, the sleeve 3 is manually pulled out of the sleeve 3 and over the opening of the receptacle 1. Preferably, the sleeve 3 is laterally connected onto a rear wall 12 of the receptacle 1. The rear wall 12 is an exterior wall of the receptacle 1 with a large flat surface for mounting the sleeve 3. Similarly, the sleeve 3 is substantially planar in shape to conform to the flat shape of the flexible lid 2.

In the preferred embodiment, the flexible lid 2 is slidably engaged across a first sidewall 13 and a second sidewall 14 of the receptacle 1. The first sidewall 13 and the second sidewall 14 are positioned opposite each other. The slidable engagement allows the flexible lid 2 to slide across the top edge of the corresponding sidewall, while preventing the flexible lid 2 from separating from the receptacle 1. In one possible embodiment, the first sidewall 13 and the second sidewall 14 are each fashioned with a guide track that allows the flexible lid 2 to slide over the opening. Similarly, the flexible lid 2 may be fashioned with a pair of guide rails, each of which, connects onto the corresponding guide track.

Figure 4:
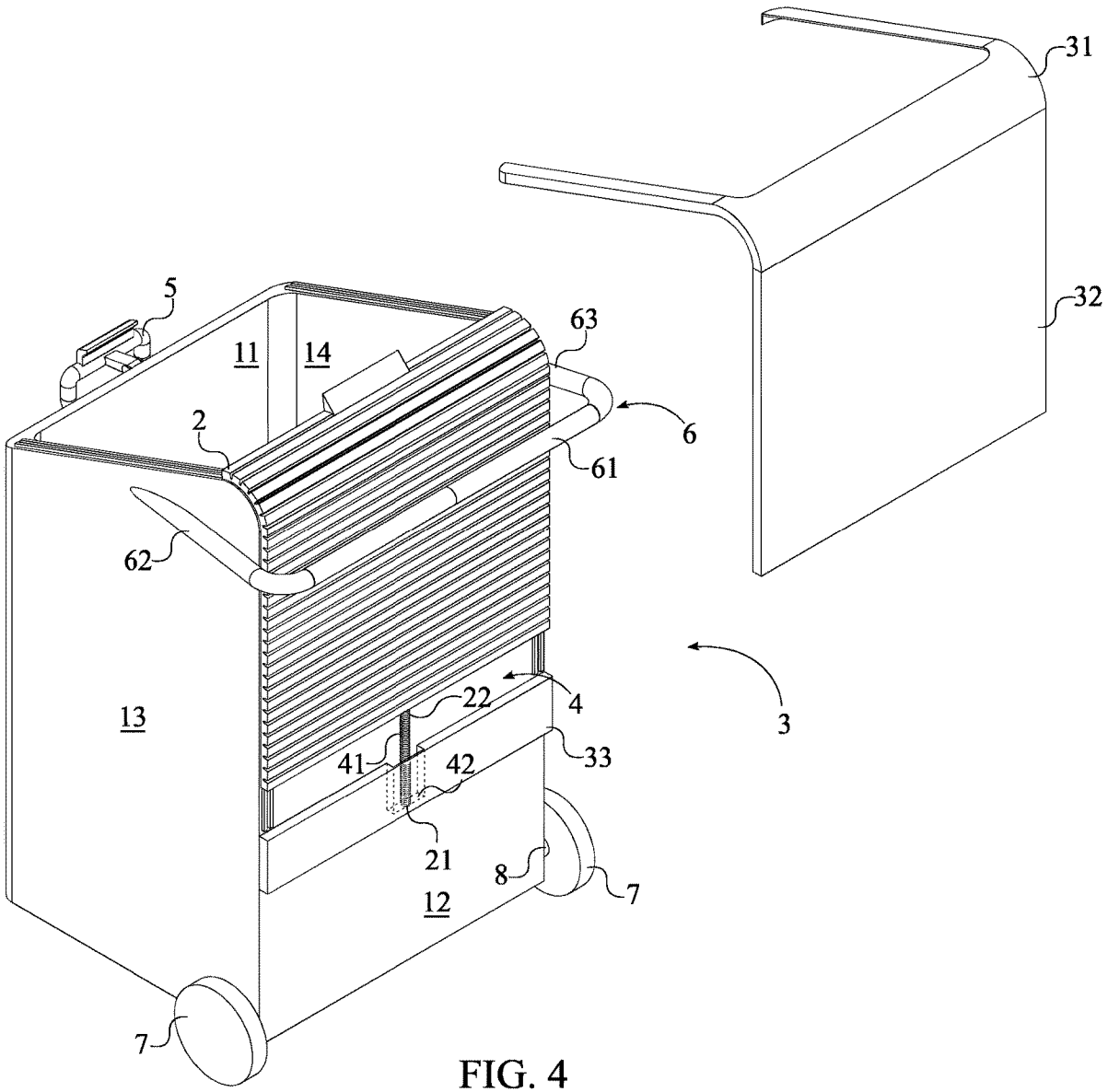
FIG. 4 is a rear perspective view of the present invention with the guide track cover and the lid cover removed, illustrating the retraction mechanism connected to the flexible lid in the open position.

Referring to FIG. 3 and FIG. 4, the retraction mechanism 4 is operably coupled in between the sleeve 3 and the flexible lid 2, wherein the retraction mechanism 4 retracts the flexible lid 2 into the sleeve 3. Accordingly, the retraction mechanism 4 provides a pulling force that pulls the flexible lid 2 into the sleeve 3. Thus, the user must physically pull the flexible lid 2 out of the sleeve 3 and lock the flexible lid 2 into the closed position using the locking mechanism 5.

Referring back to FIG. 1 and FIG. 2, the locking mechanism 5 locks the flexible lid 2 in the closed position over the opening of the receptacle 1. Accordingly, the locking mechanism 5 is operably coupled in between the flexible lid 2 and a front wall 11, wherein the locking mechanism 5 selectively prevents the flexible lid 2 from retracting into the sleeve 3. The preferred locking mechanism 5 utilizes a spring-loaded latch to lock the flexible lid 2 in the closed position. The user must manually disengage the spring-loaded latch to allow the flexible lid 2 to freely retract into the sleeve 3. Alternately, the locking mechanism 5 may utilize magnets, tabs, screws, snaps, and/or any appropriate fastening mechanism known in the relevant arts.

Referring back to FIG. 5, in one possible embodiment, the sleeve 3 may comprise a guide track cover 31, a lid cover 32, and a base 33. The guide track cover 31 encloses the first guide track 16 and the second guide track 17 on the top surface of the receptacle 1. The lid cover 32 encloses and protects the flexible lid 2 in the open position. The base 33 of the sleeve 3 provides a secure mounting point for the retraction mechanism 4.

Referring back to FIG. 3 and FIG. 4, in one possible embodiment of the present invention, the retraction mechanism 4 may be a spring that pulls the flexible lib into the sleeve 3. Further, retraction mechanism 4 may be controlled by disengaging the locking mechanism 5, thereby retracting the flexible lid 2 into the sleeve 3. Accordingly, the retraction mechanism 4 comprises the spring 41 and a first anchoring point 21. The spring 41 provides the necessary pulling force to retract the flexible lid 2 into the sleeve 3. Consequently, the first anchoring point 21 affixes the spring 41 into the sleeve 3. More specifically, the first anchoring point 21 traverses into a bottom surface 42 of the sleeve 3. Similarly, the flexible lid 2 comprises a second anchoring point 22. The second anchoring point 22 is connected to the flexible lid 2. In the preferred embodiment of the present invention, the first anchoring point 21 and the second anchoring point 22 may be hooks or latches that connect to the ends of the spring 41. As such, the spring 41 is terminally connected to the first anchoring point 21. Similarly, the spring 41 is terminally connected to the second anchoring point 22, opposite the first anchoring point 21. To close the receptacle 1, the flexible lid 2 must be manually pulled out the sleeve 3, which stretches the spring 41 and generates the pulling force. Subsequently, the locking mechanism 5 is utilized to prevent the flexible lid 2 from retracting back into the sleeve 3. To open the receptacle 1, the locking mechanism 5 is disengaged, and the spring 41 pulls the flexible lid 2 back into the sleeve 3.

Figure 7:
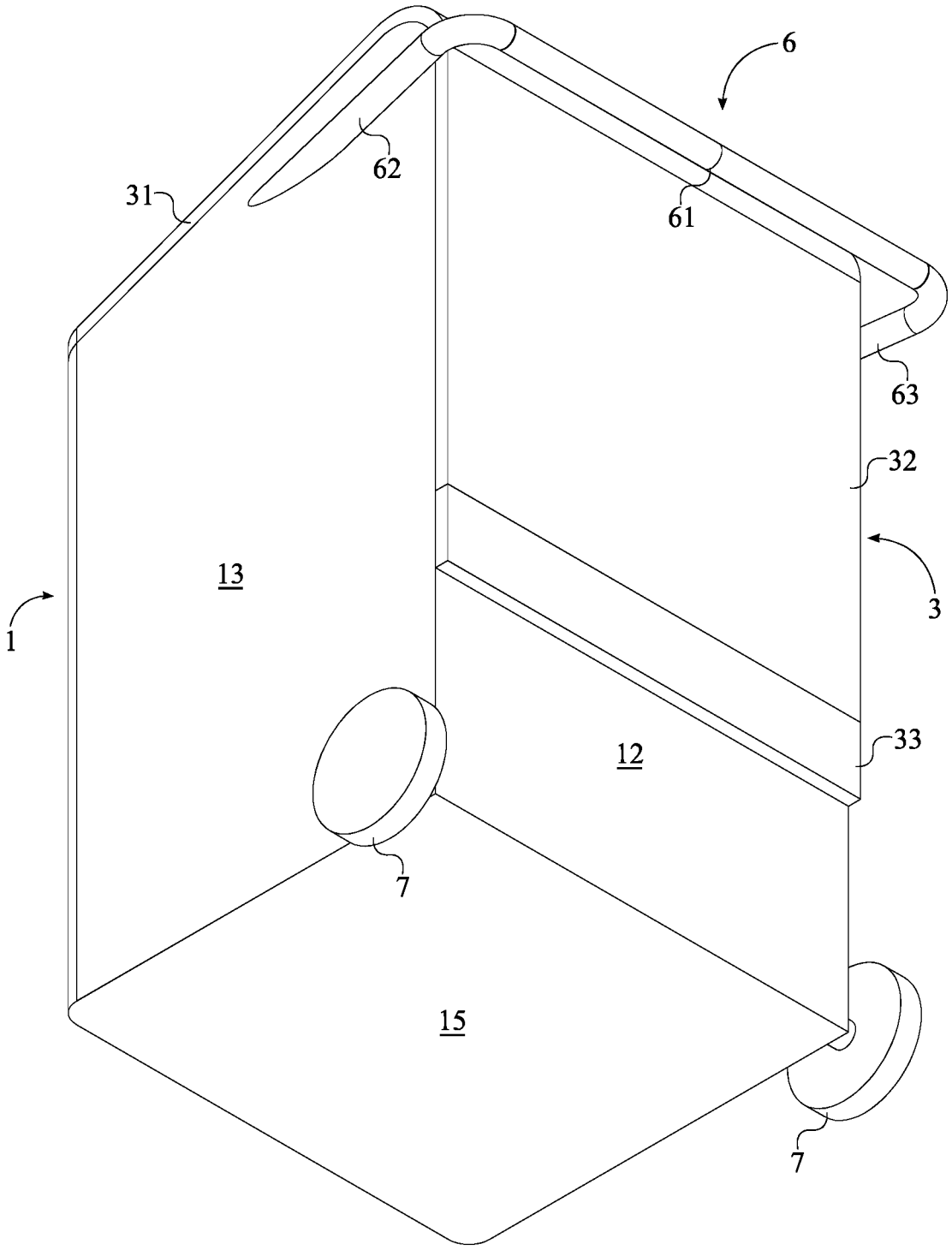
FIG. 7 is a rear bottom perspective view illustrating the position of the bottom floor relative to the first sidewall and the rear wall.

Referring now to FIG. 1 and FIG. 7, the preferred receptacle 1 is generally rectangular with four walls and a floor that define the interior compartment. The four walls are left disconnected at the top to create the opening whereby waste is disposed into the interior compartment. The locking mechanism 5 is laterally attached to the front wall 11, whereas the sleeve 3 is laterally attached to the rear wall 12. The first sidewall 13 and the second sidewall 14 are connected opposite each other across the front wall 11.

Accordingly, the rear wall 12 is connected adjacent to the first sidewall 13 and the second sidewall 14, opposite the front wall 11. The bottom floor 15 is perimetrically connected to the front wall 11, the rear wall 12, the first sidewall 13, and the second sidewall 14. This encloses the interior compartment allowing waste to be disposed therein. In alternate embodiments, the receptacle 1 may utilize any number of walls and may be any shape or size.

Figure 5:
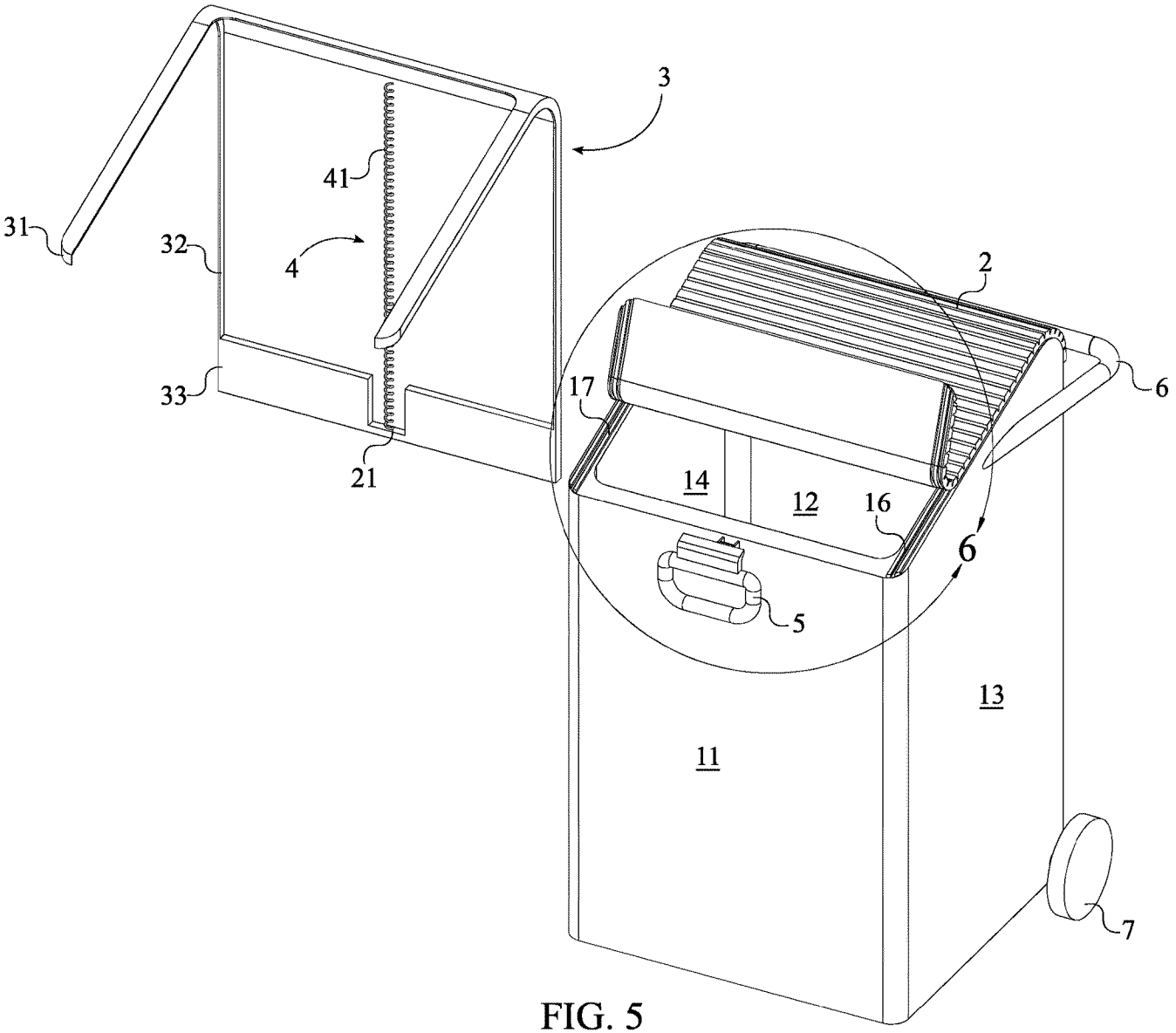
FIG. 5 is a front perspective view of the present invention with the guide track cover and the lid cover removed, illustrating the first anchoring point.
Figure 6:
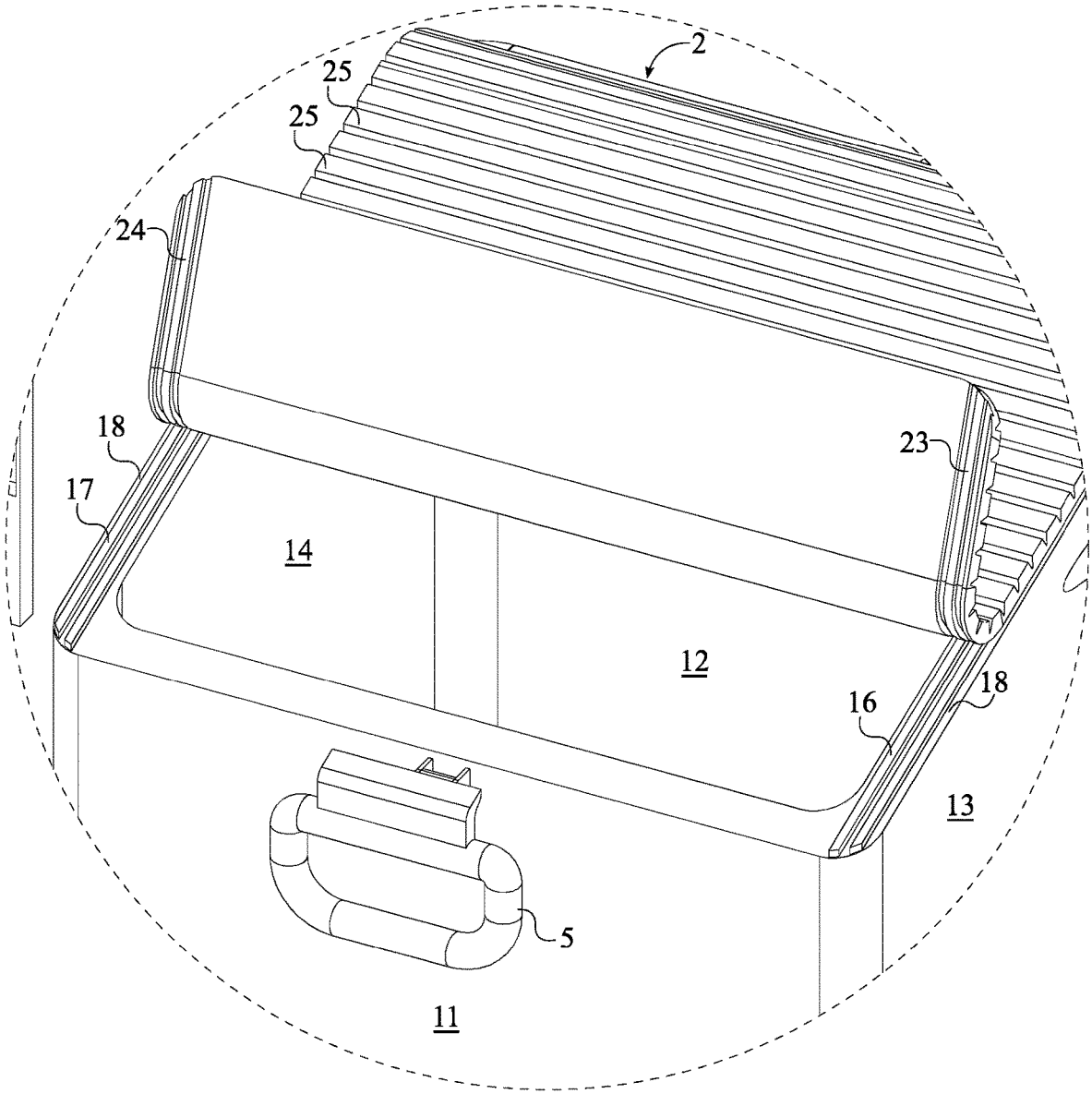
FIG. 6 is a detail view of section 6 in FIG. 5, illustrating the connection between the first guide rail, the first guide track, the second guide rail, and the second guide track.

Referring to FIG. 5 and FIG. 6, in the preferred embodiment of the present invention, the slidable connection between the flexible lid 2 and the receptacle 1 is enabled using guide tracks that engage onto guide rails. As such a first guide track 16 and a second guide track 17 are provided on the top surface of the receptacle 1. The first guide track 16 is connected along a top-edge 18 of the first sidewall 13, whereas the second guide track 17 is connected along a top-edge 18 of the second sidewall 14. Similarly, a first guide rail 23 and a second guide rail 24 are provided on the lower surface of the flexible lid 2. More specifically, the first guide rail 23 and the second guide rail 24 are connected opposite each other, about the flexible lid 2. Preferably, the first guide track 16 and the second guide track 17 also travel along the rear wall 12 and into the sleeve 3. Thus, the flexible lid 2 remains attached to the receptacle 1 even when retracted into the sleeve 3.

As can be seen in FIG. 5, the first sidewall 13 and the second sidewall 14 are curved to smoothen the transition between the vertically oriented rear wall 12 and the substantially horizontal top surface. This allows the flexible lid 2 to easily slide in and out of the sleeve 3 located to the rear of the receptacle 1.

As can be seen in FIG. 6, in the preferred embodiment, the first guide rail 23 and the second guide rail 24 are connected onto a lower surface of the flexible lid 2. This aligns the first guide rail 23 to the first guide track 16 and the second guide rail 24 to the second guide track 17. Further, the first guide rail 23 and the second guide rail 24 are U-shaped channels that snap onto the first guide track 16 and the second guide track 17. This prevents the flexible lid 2 from separating from the receptacle 1 while allowing the flexible lid 2 to freely slide over the opening of the receptacle 1. As such, the first guide rail 23 is slidably connected to the first guide track 16. Similarly, the second guide rail 24 is slidably connected to the second guide track 17.

In alternate embodiments of the present invention, the first guide rail 23 and the second guide rail 24 may be connected onto a top surface of the flexible lid 2. Accordingly, the first guide track 16 and the second guide track 17 may be connected onto the guide track cover 31 of the sleeve 3.

Figure 8:
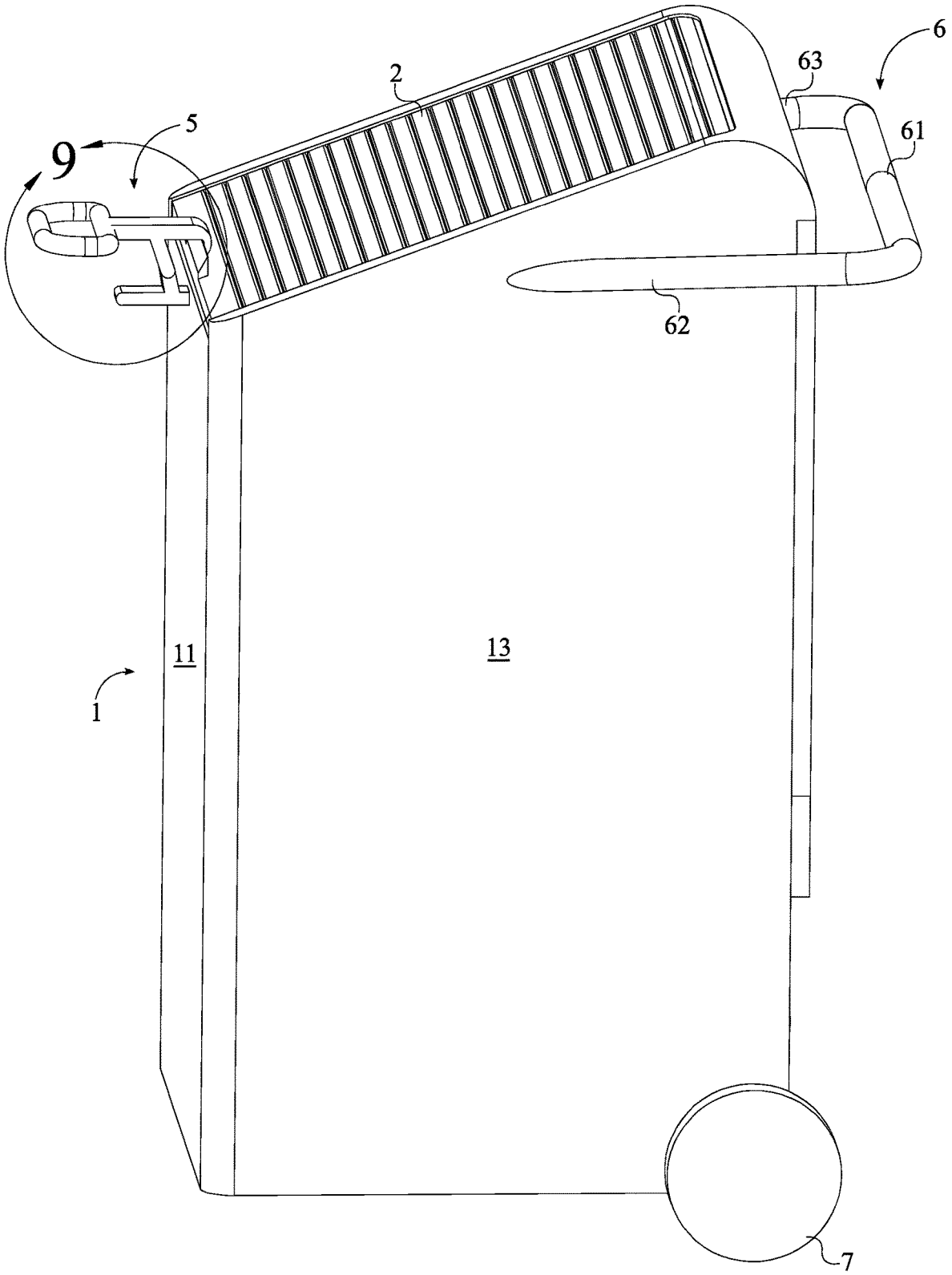
FIG. 8 is a side perspective view illustrating the locking mechanism engaged to the flexible lid.
Figure 9:
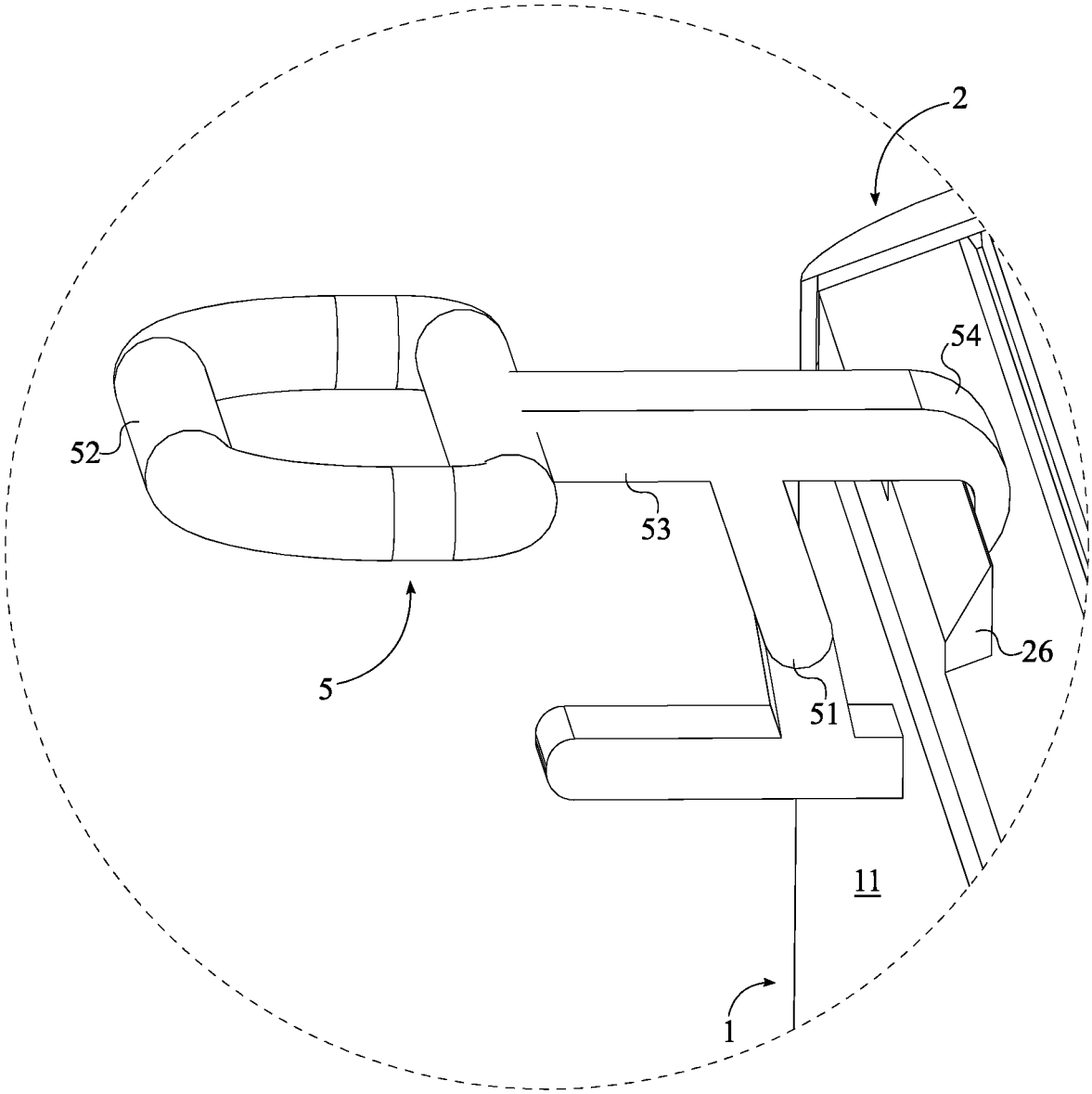
FIG. 9 is a detail view of section 9 in FIG. 8 illustrating the latch-bolt engaged to the strike plate.

Referring now to FIG. 8 and FIG. 9, in one possible embodiment, the locking mechanism 5 is provided for locking the flexible lid 2 in the closed position. The preferred embodiment of the locking mechanism 5 comprises a spring-loaded hinge 51, a handle 52, a linkage 53, and a latch-bolt 54. Further, the flexible lid 2 comprises a strike plate 26. In this embodiment of the handle 52 is used both to move the receptacle 1 and to engage and disengage the locking mechanism 5. In the closed position, the latch-bolt 54 and the strike plate 26 contact each other. To open the flexible lid 2, the handle 52 must be pushed down to disengage the latch-bolt 54 from the strike plate 26. Accordingly, the user may push to pull on the handle 52 without triggering the retraction mechanism 4.

Figure 10:
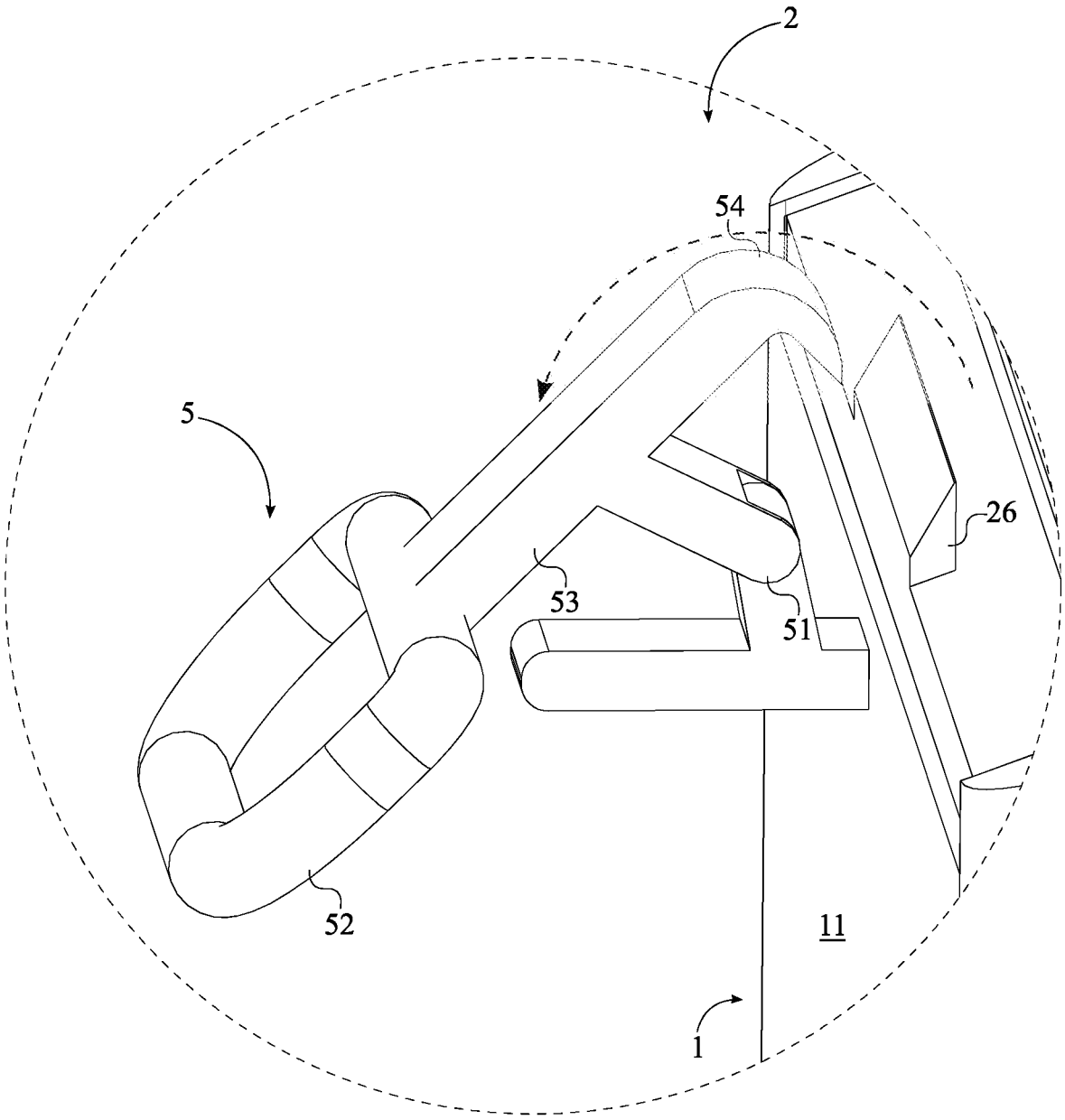
FIG. 10 is a detail view of section 9 in FIG. 8 illustrating the latch-bolt disengaged from the strike plate.

Referring to FIG. 10, in this embodiment the latch-bolt 54 is terminally connected onto the linkage 53. Accordingly, the handle 52 is terminally connected onto the linkage 53, opposite the latch-bolt 54. Further, the strike plate 26 is terminally connected onto the flexible lid 2, opposite the retraction mechanism 4. As such, the linkage 53 acts as a lever with the the spring-loaded hinge 51 acting as a fulcrum. When the user pushes down on the handle 52, the latch-bolt 54 is disengaged from the strike-plate, thereby freeing the flexible lid 2 to retract into the sleeve 3. By orienting the linkage 53 parallel to the ground, the user can pull or push the receptacle in the horizontal direction without disengaging the latch-bolt 54 from the strike plate.

Referring now to FIG. 4, a pair of wheels 7 and an axle 8 is provided to help the user transport the receptacle 1. The axle 8 allows the pair of wheels 7 to rotatably connect onto the receptacle 1. In the preferred embodiment, the axle 8 is connected adjacent to the rear wall 12. This allows the user to balance the weight of the fully loaded receptacle 1 on a single axle 8. Accordingly, each wheel is connected opposite each other, about the receptacle 1. Preferably, each wheel is rotatably connected onto a corresponding end of the axle 8. Further, the distance between each wheel, as dictated by the length of the axle 8, is long enough to prevent the receptacle 1 from tipping sideways.

In another possible embodiment of the present invention, a pair of axles 8 may be utilized along with the pair of wheels 7. Accordingly, each of the pair of axles 8 is connected opposite each other about the receptacle 1. Similarly, each of the pair of wheels 7 is rotatably connected onto a corresponding axle 8. Unlike the single axle 8, which traverses through the whole receptacle 1 thus reducing the volume of the interior compartment, the pair of axles 8 does not traverse into the interior compartment.

To help the user balance the receptacle 1 on the pair of wheels, a rear handle 6 is provided. The rear handle 6 allows the user to securely tilt the receptacle 1 to place the weight over the pair of wheels 7. The preferred embodiment of the rear handle 6 comprises a gripping bar 61, a first anchor 62, and a second anchor 63. The gripping bar 61 is a cylindrical bar made of high grip materials that can be grasped by the user while wearing gloves. Further, the gripping bar 61 may comprise grooves that allow the user to get a better grip. The first anchor 62 and the second anchor 63 are positioned opposite each other about the gripping bar 61. The first anchor 62 and the second anchor 63 attach the gripping bar 61 to the receptacle 1 without reducing the gripping surface available to the user. As such, the first anchor 62 is connected adjacent to the first sidewall 13. Similarly, the second anchor 63 is connected adjacent to the second sidewall 14. In the preferred embodiment, the axle 8 acts as a fulcrum that helps the user gain leverage to easily tilt the receptacle 1. To maximize the leverage, the gripping bar 61 is positioned as far as possible from the axle 8. This positions the gripping bar 61 offset from the sleeve 3. This allows the user to simply press down on the gripping bar 61 to tilt the receptacle 1 backwards.

Referring back to FIG. 6, in the preferred embodiment, the flexible lid 2 is constructed in the same manner as a tambour used in roll-top desks. Accordingly, the flexible lid 2 comprises a plurality of rigid panels 25. Further, the plurality of rigid panels 25 is rotatably connected to each other. Each rigid panel 25 may be fashioned with a groove on one side and a protrusion that fits into the groove on the opposite side. This allows each of the plurality of rigid panels 25 to interlock into an adjoining rigid panel 25. As such, this allows the adjoining rigid panel 25 to rotate freely without separating. Accordingly, the flexible lid 2 can bend and flex to around corners while remaining attached to the first guide track 16 and the second guide track 17.

Although the invention has been explained in relation to its preferred embodiment, it is to be understood that many other possible modifications and variations can be made without departing from the spirit and scope of the invention as hereinafter claimed.

What is claimed is:

1. An automatic, roll-top waste container with a spring-activated lid comprises:

a receptacle;

a flexible lid;

a sleeve;

a retraction mechanism;

a locking mechanism;

the sleeve being laterally connected onto a rear wall of the receptacle;

the flexible lid being slidably engaged across a first sidewall and a second sidewall of the receptacle;

the retraction mechanism being operably coupled in between the sleeve and the flexible lid, wherein the retraction mechanism retracts the flexible lid into the sleeve;

the locking mechanism being operably coupled in between the flexible lid and a front wall, wherein the locking mechanism selectively prevents the flexible lid from retracting into the sleeve;

the retraction mechanism comprises a spring and a first anchoring point;

the flexible lid comprises a second anchoring point;

the first anchoring point traversing into a bottom surface of the sleeve;

the spring being terminally connected to the first anchoring point;

the spring being terminally connected to the second anchoring point, opposite the first anchoring point;

the locking mechanism comprises a spring-loaded hinge, a handle, a linkage, and a latch-bolt;

the flexible lid comprises a strike plate;

the spring-loaded hinge being laterally connected onto the front wall;

the linkage being terminally and rotatably connected onto the spring-loaded hinge;

the latch-bolt being terminally connected onto the linkage;

the handle being terminally connected onto the linkage, opposite the latch-bolt;

the strike plate being terminally connected onto the flexible lid, opposite the retraction mechanism; and the strike plate protruding from the flexible lid.

2. The automatic, roll-top waste container with a spring-activated lid as claimed in claim 1 comprises:

a first guide track;

a first guide rail;

a second guide track;

a second guide rail;

the first guide track being connected along a top-edge of the first sidewall;

the second guide track being connected along a top-edge of the second sidewall;

the first guide rail and the second guide rail being positioned opposite each other, about the flexible lid;

the first guide rail being slidably connected to the first guide track; and the second guide rail being slidably connected to the second guide track.

3. The automatic, roll-top waste container with a spring-activated lid as claimed in claim 1 comprises:

the first sidewall and the second sidewall being connected opposite each other across the front wall;

the rear wall being connected adjacent to the first sidewall and the second sidewall, opposite the front wall; and a bottom floor being perimetrically connected to the front wall, the rear wall, the first sidewall, and the second sidewall.

4. The automatic, roll-top waste container with a spring-activated lid as claimed in claim 1 comprises:

a pair of wheels;

an axle;

the axle being positioned adjacent to the rear wall; and each wheel being connected opposite each other, about the receptacle.

5. The automatic, roll-top waste container with a spring-activated lid as claimed in claim 1 comprises:

a rear handle;

the rear handle comprises a gripping bar, a first anchor, and a second anchor;

the first anchor and the second anchor being positioned opposite each other about the gripping bar;

the first anchor being connected adjacent to the first sidewall;

the second anchor being connected adjacent to the second sidewall; and the gripping bar being positioned offset from the sleeve.

6. The automatic, roll-top waste container with a spring-activated lid as claimed in claim 1 comprises:

the flexible lid comprises a plurality of rigid panels; and the plurality of rigid panels being rotatably connected to each other.

* * * * *